US011652316B2

(12) United States Patent
Dendas et al.

(10) Patent No.: US 11,652,316 B2
(45) Date of Patent: May 16, 2023

(54) RETENTION CLIP FOR A MECHANICAL STRAIN RELIEF OF A CABLE

(71) Applicants: TE Connectivity Nederland BV, s'Hertogenbosch (NL); Tyco Electronics Austria GmbH, Vienna (AT)

(72) Inventors: Freddy Jean Philip Dendas, 's-Hertogenbosch (NL); Frank Rosenkranz, Vienna (AT)

(73) Assignees: TE Connectivity Nederland BV, s'Hertogenbosch (NL); Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 17/371,729

(22) Filed: Jul. 9, 2021

(65) Prior Publication Data

US 2022/0013953 A1 Jan. 13, 2022

(30) Foreign Application Priority Data

Jul. 10, 2020 (EP) ..... 20185341

(51) Int. Cl.
*H01R 13/58* (2006.01)

(52) U.S. Cl.
CPC ..... *H01R 13/5816* (2013.01)

(58) Field of Classification Search
CPC ..... H01R 13/5816; H01R 13/585; H01R 13/5812; H01R 13/565
See application file for complete search history.

(56) References Cited

U.S. PATENT DOCUMENTS

| | | | | |
|---|---|---|---|---|
| 6,100,614 | A | 8/2000 | Lin | |
| 2016/0211592 | A1* | 7/2016 | Wendt | H01R 4/4827 |
| 2016/0281881 | A1 | 9/2016 | Vaccaro et al. | |
| 2019/0173219 | A1* | 6/2019 | Sakai | H01R 4/52 |
| 2020/0328556 | A1 | 10/2020 | Takeuchi et al. | |

FOREIGN PATENT DOCUMENTS

| | | | |
|---|---|---|---|
| EP | 3425738 | A1 | 1/2019 |
| WO | 2019082784 | A1 | 5/2019 |

OTHER PUBLICATIONS

European Patent Office Search Report, dated Dec. 15, 2020, 7 pages.

* cited by examiner

*Primary Examiner* — Jean F Duverne
(74) *Attorney, Agent, or Firm* — Barley Snyder

(57) ABSTRACT

A retention clip providing mechanical strain relief of a cable in a connector comprises two curved spring sections each having a free end and a base, the two curved spring sections separated from each other at their respective free ends by a cable insertion gap. A center section of the retention cable extends from the base of one of the two curved spring sections to the base of the other one of the two curved spring sections and includes a cable insertion opening. The cable insertion gap and the cable insertion opening are aligned providing a through-opening extending through the retention clip in a cable insertion direction, and each of the free ends has at least one discontinuity in a direction along its edge.

20 Claims, 5 Drawing Sheets

RETENTION CLIP FOR A MECHANICAL STRAIN RELIEF OF A CABLE

CROSS-REFERENCE TO RELATED APPLICATIONS

This application claims priority under 35 U.S.C. § 119 to EP Patent Application No. 20185341.3, filed Jul. 10, 2020, the entire disclosure of which is incorporated herein by reference.

FIELD OF THE INVENTION

The present disclosure relates to cable connectors, and more particularly, to a retention clip for mechanical strain relief of a cable in a connector.

BACKGROUND

Cables are often installed between spaced-apart technical units in order to transfer power and/or signals therebetween. In the field of electrical engineering, for example, a conductive core of an electrical cable is electrically connected with conductive counterparts of electrical units, respectively. These electrical connections may be achieved in a separable manner using electrical connectors. Furthermore, permanent joining techniques such as crimping, clamping, soldering, and/or welding may also be involved in these electrical connections.

As electrical connections are mainly designed with a focus on their electrical performance, they often exhibit poor mechanical stability. As a result, mechanical strain relief structures are commonly utilized, which receive and divert mechanical loads acting on the electrical cable. The mechanical strain relief structures may thus help to avoid an unwanted pull-out of the electrical cable from the electrical connector or prevent damage at the permanent joinings, for example, due to improper handling of the electrical cable.

Existing strain relief structures usually comprise a multitude of separate components, such as clamps and screws, and/or require a time-consuming installation process. In addition, many existing strain relief structures are installed by clamping the electrical cable with excessive force in order to fixate the electrical cable to the electrical connector or electrical unit, respectively. This poses an inherent threat to the cable's integrity. Furthermore, the electrical cable often tends to slip within many existing strain relief structures when twisted.

Therefore, it is desirable for a mechanical strain relief structure to have a low number of components, be easily and quickly installable, while protecting the electrical cable against twisting without causing unnecessary damage to the electrical cable.

SUMMARY

According to an embodiment of the present disclosure, a retention clip providing mechanical strain relief of a cable in a connector comprises two curved spring sections, each having a free end including at least one discontinuity in a direction along its length, and a base. The two curved spring sections are separated from each other at their respective free ends by a cable insertion gap. A center section of the retention cable extends from the base of one of the two curved spring sections to the base of the other one of the two curved spring sections and includes a cable insertion opening. The cable insertion gap and the cable insertion opening are aligned providing a through-opening extending through the retention clip in a cable insertion direction. Each one of the free ends further defines at least one discontinuity in a direction along its edge.

BRIEF DESCRIPTION OF THE DRAWINGS

The invention will now be described by way of example with reference to the accompanying Figures, of which.

DETAILED DESCRIPTION OF THE EMBODIMENTS

Figure 1:
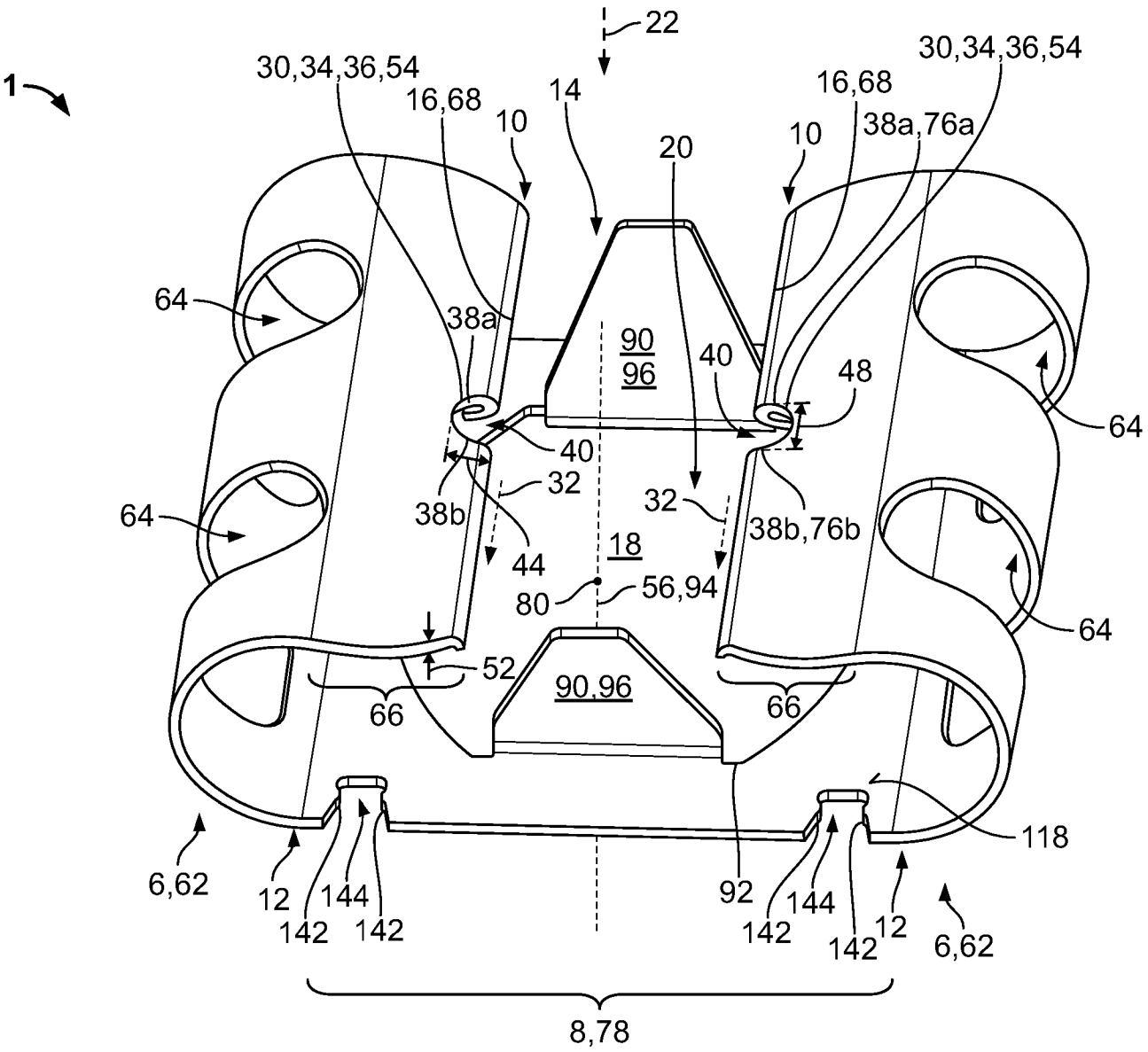
FIG. 1 is a schematic illustration of a perspective view of a retention clip according to one embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the following, the structure of possible embodiments of a retention clip 1, a cable assembly 2 and a connector 4 according to the present invention is explained with reference to the exemplary embodiments shown in FIGS. 1 to 5.

FIG. 1 shows a perspective view of the retention clip 1 according to one possible embodiment of the present disclosure. The retention clip 1 may be a stamped and bent piece made of stainless steel. Alternatively, the retention clip 1 may be made of a material with a yield strength of at least 930 MPa. As shown, the retention clip 1 comprises two curved spring sections 6 and a center section 8. Each of the two curved spring sections 6 has a free end 10 and a base 12. The two curved spring sections 6 are separated from each other at their respective free ends 10 by a cable insertion gap 14. In particular, the free ends 10 of the two curved spring sections 6 may each have an edge 16. The edges 16 may be arranged opposite to each other with respect to the cable insertion gap 14. The edges 16 may further be parallel to each other and may also extend parallel to the center section 8. The center section 8 extends from the base 12 of one of the two curved spring sections 6 to the base 12 of the other one of the two curved spring sections 6. Consequently, the two curved spring sections 6 may be monolithically connected at their respective bases 12 by the center section 8. Further, the center section 8 comprises a cable insertion opening 18.

Figure 2:
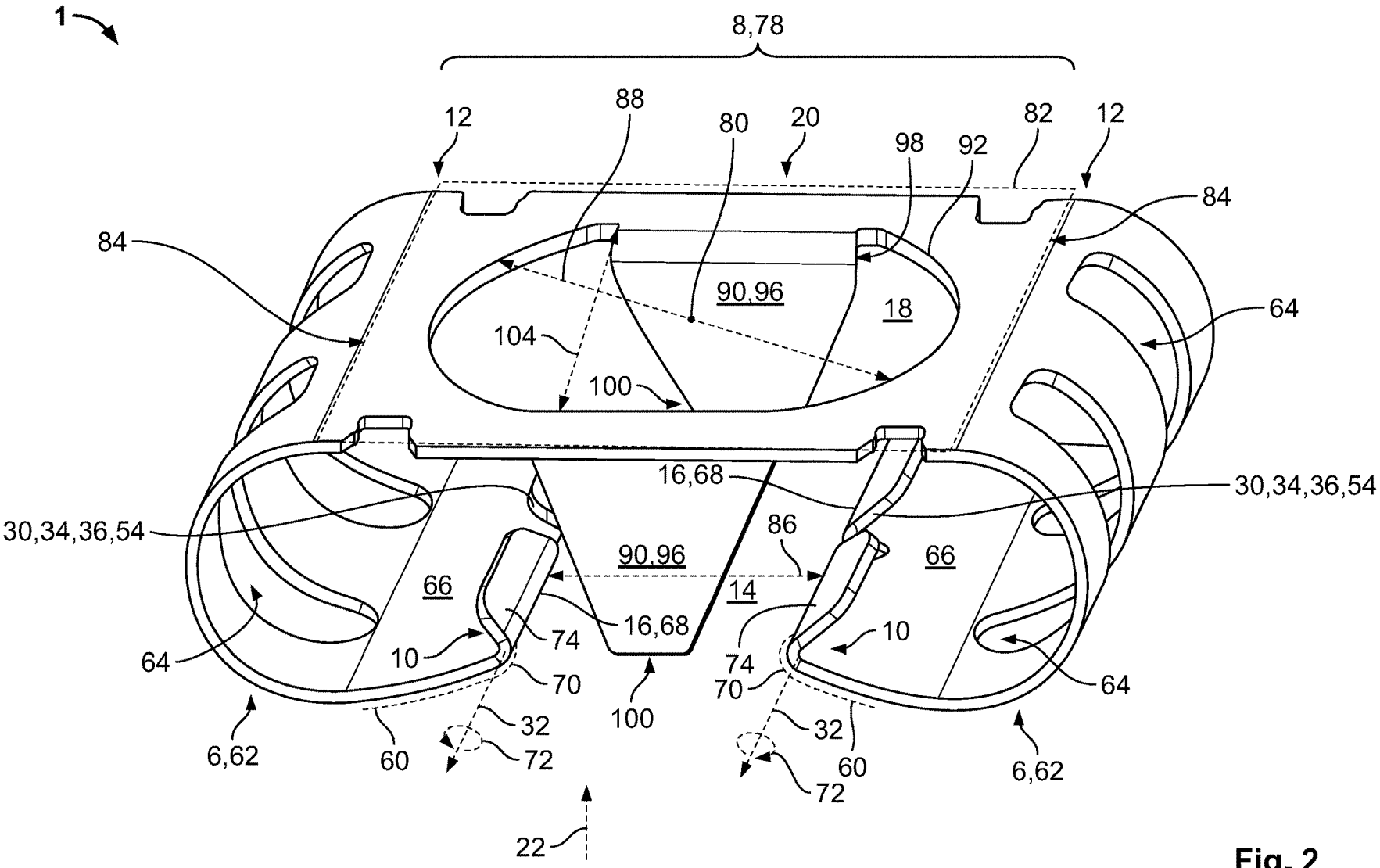
FIG. 2 is a schematic illustration of another perspective view of the retention clip according to the embodiment shown in FIG. 1.
Figure 3:
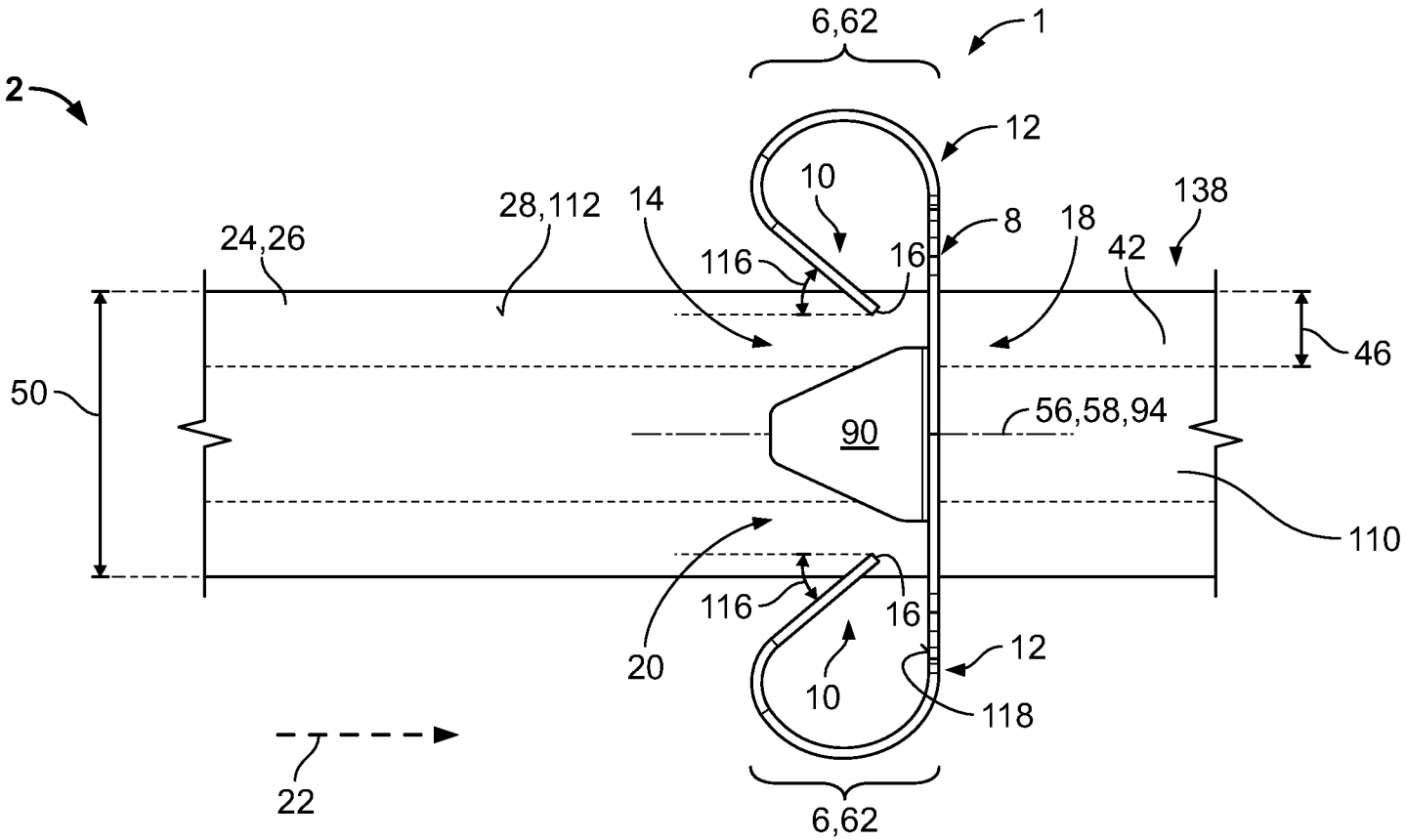
FIG. 3 is a schematic illustration of a top view of a cable assembly according to one embodiment of the present disclosure.

As shown in FIGS. 1-3, the cable insertion gap 14 and the cable insertion opening 18 are aligned and provide a through-opening 20 extending through the retention clip 1 in a cable insertion direction 22. As will be described further herein, a cable 24, such as an electrical cable 26, may be passed through the through-opening 20 to be gripped by the retention clip 1. In particular, a cable jacket surface 28 of the cable 24 abuts against the edges 16 of the free ends 10.

As shown in FIGS. 1 and 2, each of the free ends 10 has at least one discontinuity 30 in a direction 32 along its respective edge 16. The at least one discontinuity 30 of at least one free end 10 may comprise at least one of a recess 34 or a protrusion. In the exemplary embodiment of FIG. 1, both free ends 10 have the at least one discontinuity 30 comprising one recess 34. The recess 34 is a concave cut-out 36 extending from the edge 16 of the corresponding free end 10 into the corresponding curved spring section 6. The recess 34 has a round shape, more specifically a semi-circular shape. Alternatively, the recess may also be an indentation and/or have an oval shape (not shown).

As shown in FIG. 1, the recess 34 creates two juxtaposed, mirror-inverted shoulders 38*a*, 38*b* on the corresponding free end 10. A break 40 in the edge 16 of the corresponding free end 10 is formed between the shoulders 38*a*, 38*b*. When the cable 24 is gripped by the retention clip 1, the cable jacket 42 may be locally deformed such that material of the cable jacket 42 enters the recess 34. Thereby a form fit between the cable jacket 42 and the two shoulders 38*a*, 38*b* may be created. As a result, the transfer of torsional forces oriented in the circumferential direction of the cable are improved, and relative rotational movement between the cable and retention clip impeded.

A depth 44 of the respective recess 34 measured perpendicularly to the corresponding edge 16 is preferably smaller than a material thickness 46 of the cable jacket 42 (see FIG. 3). A width 48 of the respective recess 34 measured parallel to the corresponding edge 16 is preferably smaller than an outer diameter 50 of the cable jacket 42 (see FIG. 3). Further, each recess 34 may preferably have its depth 44 and/or width 48 larger than the material thickness 52 of the corresponding free end 10.

The discontinuities 30 of both free ends 10 may be arranged opposite to each other, preferably diametrically opposite to each other. In other words, for each discontinuity 30 of one free end 10, there may be a counterpart discontinuity 54 arranged at a diametrically opposite position of the respective other free end 10. This opposite arrangement may be done with respect to the cable insertion gap 14 and/or with respect to a center line 56 of the cable insertion opening 18. This is also shown in FIG. 1.

The at least one discontinuity 30 of at least one free end 10 may be positioned in the middle of the edge 16 of the corresponding free end 10. Further, the at least one discontinuity 30 of at least one free end 10 may overlap with the cable insertion opening 18 in the cable insertion direction 22. In the shown exemplary embodiment of FIG. 1, the at least one discontinuity 30 of each free end 10 is positioned in the middle of the corresponding edge 16 and overlaps with the cable insertion opening 18, respectively. In particular, each recess 34 is aligned with the cable insertion opening 18 in the cable insertion direction 22 and arranged in the middle of the respective edge 16.

Additionally or alternatively, the at least one discontinuity 30 of at least one free end 10 may comprise a protrusion. In particular, the protrusion may be convex and project from the edge 16 of the corresponding free end 10 towards the edge 16 of the respectively opposite free end 10. The retention clip 1 may be symmetrical with respect to a plane 58 extending perpendicularly to the center section 8 (see FIG. 5).

The perspective view of the retention clip 1 of FIG. 2 shows that the free ends 10 of the curved spring sections 6 may be angled towards the center section 8 and partly cover the cable insertion opening 18 in the cable insertion direction 22. In particular, the free ends 10 of the curved spring sections 6 may form lead-in chamfers 60 towards the cable insertion opening 18.

As can be seen in FIGS. 1 and 2, the curved spring sections 6 may extend away from the cable insertion opening 18 at their respective bases 12 and may be curled back towards the cable insertion opening 18, such that their respective free ends 10 generally point towards the cable insertion opening 18. The free ends 10 may further be spaced apart from the center section 8 in the cable insertion direction 22, increasing an available range of motion of the free ends.

In particular, the two curved spring sections 6 may be formed by flexible spring fingers 62 extending in a curved manner between the respective free end 10 and base 12. The spring fingers 62 may exhibit multiple, preferably mutually parallel, slits 64 extending through the spring fingers 62 in the direction of their curvature. The curvature may be continuous and have a degree of curvature equal to or larger than 180°. The respective free ends 10 of the curved spring sections 6, may be formed by substantially straight sections 66 of the spring fingers 62, which transition into said curvature.

FIG. 2 shows that the free ends 10 of the curved spring sections 6 may have rounded edges 68. A rounding 70 of each rounded edge 68 may extend in a circumferential direction 72 with respect to the direction 32 along the respective edge 16. In particular, the rounded edges 68 may be formed by bending an outer section 74 of the free ends 10 i.e., the straight sections 66, inwardly or outwardly. The bending of the free ends 10 may result in the free ends 10 having two layers of material at their respective outer sections 74. Preferably, corners 76*a*, 76*b* of the shoulders 38*a*, 38*b* are sharper than the roundings 70 of the rounded edges 68 (see FIG. 1).

According to another embodiment, the free ends may have two or more discontinuities. For example, multiple recesses and/or protrusions may be formed on the edges of the free ends resulting in a waved or riffled edge, respectively. In this case, the waves or riffles are aligned along the direction of the corresponding edge.

As is further shown in FIG. 2, the center section 8 may be formed by a perforated sheet section 78 having the cable insertion opening 18 in the center 80 of the sheet section 78, such that the sheet section 78 forms a frame 82 around the cable insertion opening 18. The sheet section 78 of the shown exemplary embodiment is rectangular, preferably square. Furthermore, the sheet section 78 may be flat and straight.

The flexible spring fingers 62 may extend from two opposite rims 84 of the perforated sheet section 78, while the straight sections 66 of the flexible spring fingers 62, corresponding to the edges 16 of the free ends 10, at least partially overlap with the cable insertion opening 18 in the cable insertion direction 22. Thereby, the cable insertion opening

18 may have a larger clear width than the cable insertion gap 14. In particular, a distance 86 between the opposite edges 16 of the free ends 10 may be shorter than a diameter 88 of the cable insertion opening 18.

Optionally, the retention clip 1 may comprise two guiding flaps 90, which protrude from the center section 8 towards the cable insertion gap 14. As shown in FIG. 1, the guiding flaps 90 preferably protrude from a circumference 92 of the cable insertion opening 18 on two opposite sides thereof. The guiding flaps 90 extend obliquely away from a center axis 94 of the through-opening 20 provided by the cable insertion gap 14 and the cable insertion opening 18. In particular, the guiding flaps 90 may be formed by cantilever tabs 96 having their supported ends 98 bent towards the cable insertion gap 14 and their unsupported ends 100 arranged opposite to each other with respect to the cable insertion gap 14 (see FIG. 2). A distance 102 between the unsupported ends 100 of the guiding flaps 90 may be larger than a distance 104 between the supported ends 98 of the guiding flaps 90, resulting in a lead-in chamfer 106 (see FIG. 4).

FIG. 3 shows a top view of the cable assembly 2, comprising the retention clip 1 according to any one of the embodiments described above and a cable 24 that is passed in the cable insertion direction 22 through the cable insertion gap 14 and the cable insertion opening 18 of the retention clip 1. In the shown exemplary embodiment, the cable 24 is an electrical cable 26 comprising a conductive core 110 circumferentially surrounded by a cable jacket 42. Alternatively, the cable 24 may also be an optical cable or a cable comprising means for transmitting both electrical and optical signals and/or power.

The free ends 10 of the curved spring sections 6 are elastically pressed against an outer surface 112 of the cable 24 e.g., a cable jacket surface 28. The at least one discontinuity 30 of each free end 10 abuts against the outer surface 112 of the cable 24. Preferably, the free ends 10 of the curved spring sections 6 are outwardly defected by the cable jacket surface 28. Further, the free ends 10 are angled with respect to the outer surface 112 of the cable 24 and point towards the cable insertion opening 18. Preferably, each free end 10 is inclined by an angle 116 relative to the cable insertion direction 22. Advantageously, the angle 116 may for example amount to 30° to 40°. Thereby, the cable 24 is gripped between the edges 16 of the free ends 10 in a self-locking manner. The necessary angle 116 for achieving a self-lock may vary depending on the outer diameter 50 of the cable jacket 42, the material of the cable jacket 42, the material of the retention clip 1 and/or any other substance present between the cable jacket 42 and the retention clip 1, such as a sealing gel.

As also shown in FIG. 3, the guiding flaps 90 protrude on the same face 118 of the center section 8 as the two curved spring sections 6. In particular, the guiding flaps 90 may extend from between the bases 12 of the curved spring sections 6 towards and beyond the free ends 10 of the curved spring sections 6.

Figure 4:
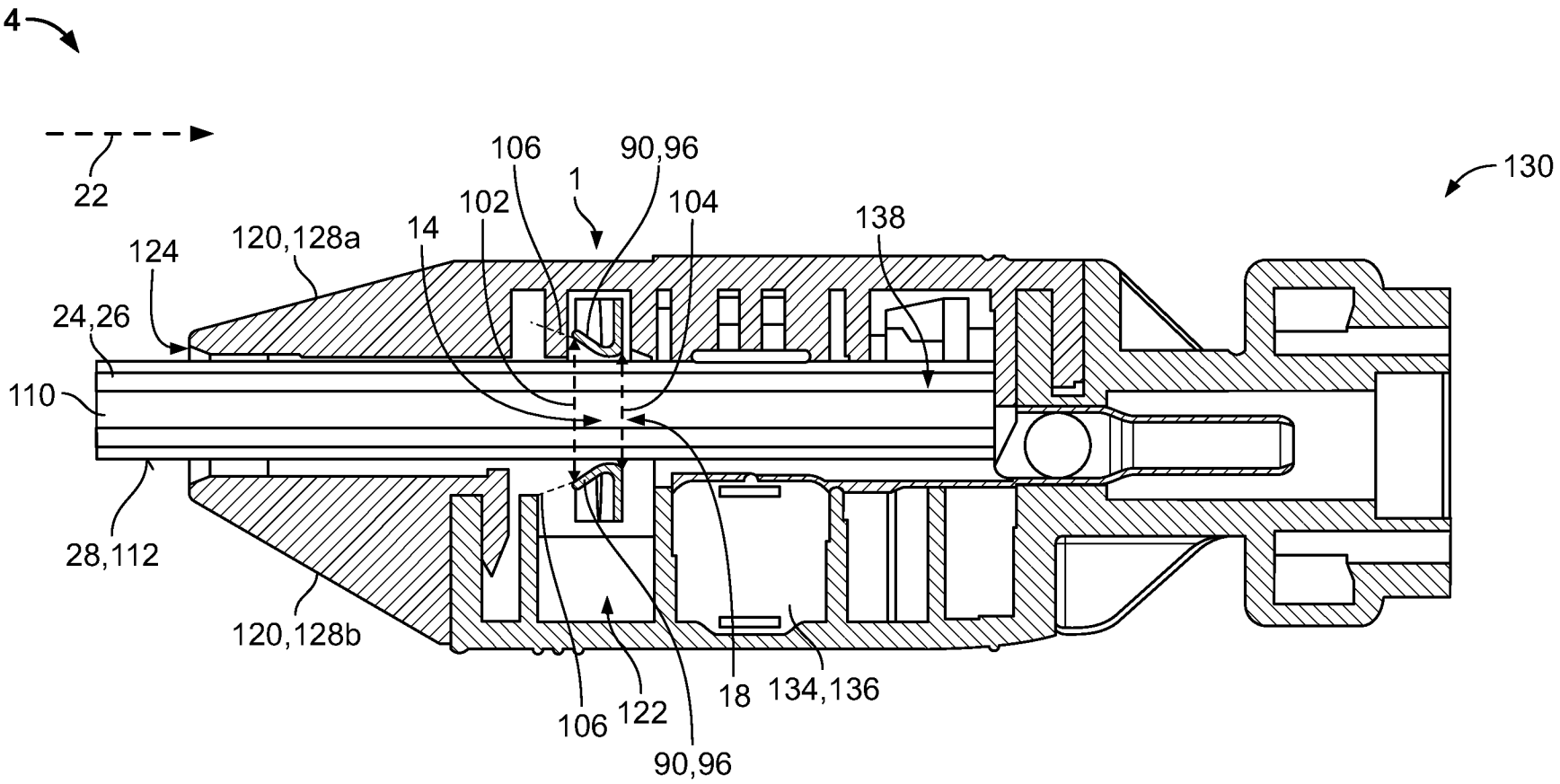
FIG. 4 is a schematic illustration of a sectional view of a connector according to one embodiment of the present disclosure.
Figure 5:
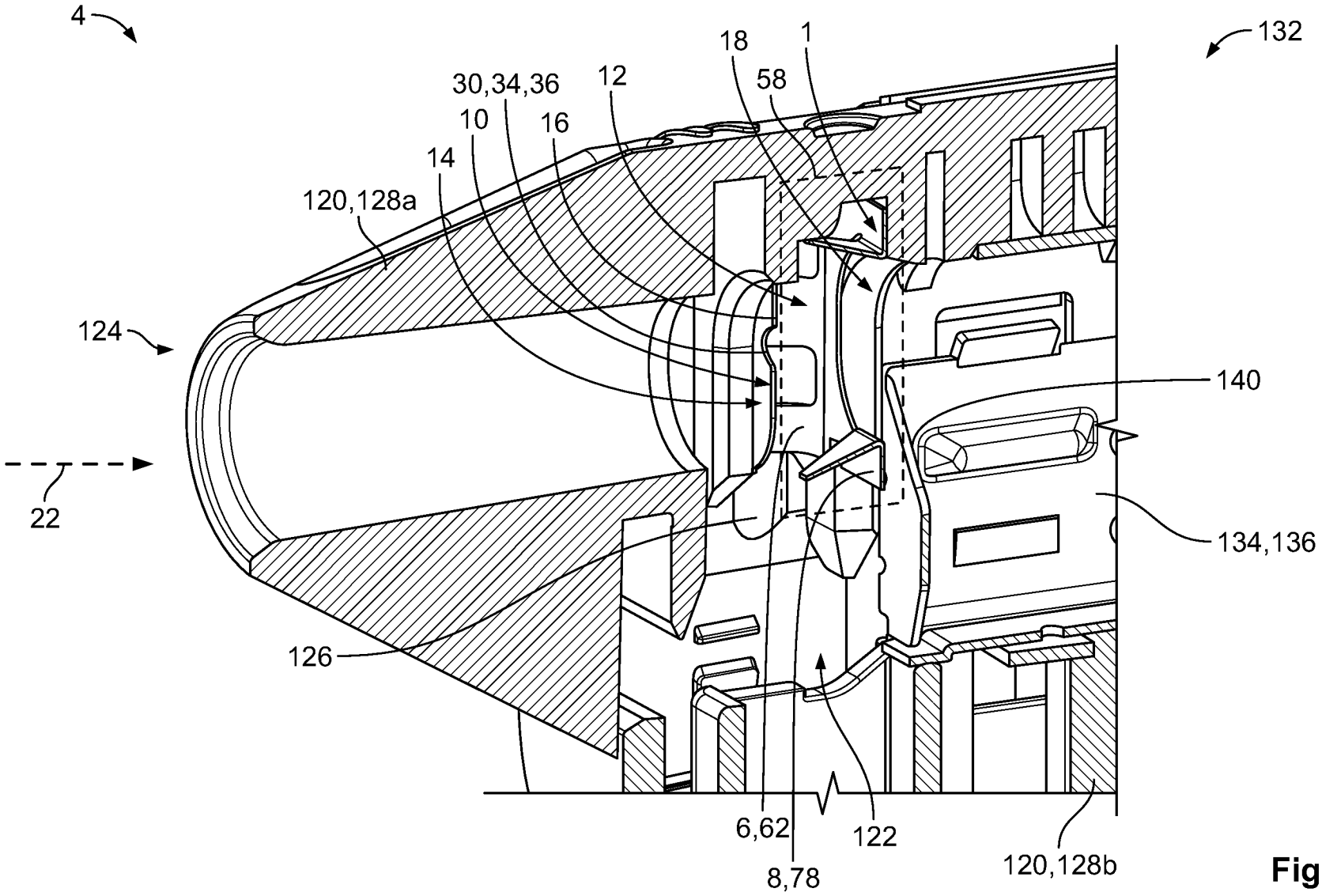
FIG. 5 is a schematic illustration of another sectional view of a connector according to one embodiment of the present disclosure.

FIGS. 4 and 5 show the connector 4 in a sectional view. The connector 4 comprises a retention clip 1 according to any one of the embodiments described above and a connector housing 120. The connector housing 120 has a reception chamber 122 and a cable insertion aperture 124 for feeding a cable 24 into the reception chamber 122, wherein the retention clip 1 is integrated in the reception chamber 122, the cable insertion opening 18 of the retention clip 1 being aligned with the cable insertion aperture 124 of the connector housing 120. Further, the cable insertion gap 14 of the retention clip 1 is arranged between the cable insertion aperture 124 and the cable insertion opening 18.

As can be seen in FIG. 5, inner walls 126 of the reception chamber 122 may be shaped complementarily to the curved spring sections 6 of the retention clip 1. In particular, the retention clip 1 fits snugly into the reception chamber 122. Preferably, the curved spring sections 6 of the retention clip 1 abut along their entire curvature against the inner walls 126 of the retention chamber 122.

The connector housing 120 may comprise two mateable housing halves 128*a*, 128*b*, which jointly form the connector housing 120 in an assembled state 130 and surround the retention clip 1 entirely, as shown in FIG. 4. In particular, the two housing halves 128*a*, 128*b* may each comprise at least part of the reception chamber 122 and be assembled by means of a screw connection, latching connection and/or adhesive connection.

In a state prior to assembling the two housing halves 128*a*, 128*b*, the retention clip 1 can be placed into one part of the reception chamber 122 of one of the housing halves 128*b*. Thereafter, the housing halves may be pre-assembled to a state 132 as shown in FIG. 5, in which the screw connection, latching connection and/or adhesive connection is not yet established.

The connector 4 may further comprise at least one electrically conductive contact element 134 for terminating an electrical cable 26 and contacting a mating contact of a mating connector. Preferably, the at least one contact element 134 is an insulation displacement contact 136. In the pre-assembled state 132, the insulation displacement contact 136 and the retention clip 1 are each preferably placed in a different housing half 128*a*, 128*b* of the connector housing as shown in FIG. 5.

In the configuration shown in FIG. 5, an unstripped electrical cable 26 can readily be installed to the connector 4. In particular, an unstripped end 138 of the electrical cable 26 can be passed through the cable insertion aperture 124, the cable insertion gap 14 and the cable insertion opening 18. After passing the cable insertion opening 18, the unstripped end 138 of the electrical cable 26 preferably reaches a position, in which it is aligned with blades 140 of the insulation displacement contact 136 placed in the other one of the two housing halves 128*a*, 128*b*. Thereupon, the housing halves 128*a*, 128*b* are assembled by pressing both housing halves 128*a*, 128*b* together such that the unstripped end 138 of the electrical cable 26 is terminated by the insulation displacement contact 136.

Referring again to FIG. 1, the retention clip 1 may comprise multiple barbed hooks 142, which claw to the inner walls 126 of the reception chamber 122. In particular, the barbed hooks 142 may be provided in notches 144 formed at the center section 8 of the retention clip 1. The inner walls 126 of the reception chamber 122 of the connector housing 120 may have spikes or ribs formed thereon, which enter the notches 144 of the center section 8, when the retention clip 1 is placed into the reception chamber 122. Thereupon, the barbed hooks 142 claw into the spikes or ribs and secure the retention clip 1 within the reception chamber 122.

Additionally or alternatively, the retention clip 1 may comprise spikes, which are provided with the barbed hooks 142. The retention clip 1 may also be glued, soldered or welded to the inner walls 126 of the reception chamber 122. According to another alternative embodiment, the connector housing 120 may be over-molded on the retention clip 1. In a sealed embodiment of the connector 4, the reception chamber 122 may be filled with a sealing gel. The sealing gel may entirely surround the retention clip 1 and fill out the cable insertion gap 14 as well as the cable insertion opening 18.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A retention clip for providing mechanical strain relief of a cable in a connector, comprising:

two curved spring sections, each of the two curved spring sections having a free end including at least one discontinuity in a direction along its edge, and a base, the two curved spring sections being separated from each other at their respective free ends by a cable insertion gap; and a center section extending from the base of one of the two curved spring sections to the base of the other one of the two curved spring sections and comprising a cable insertion opening, the cable insertion gap and the cable insertion opening are aligned, providing a through-opening extending through the retention clip in a cable insertion direction, the free ends of the two curved spring sections partly cover the cable insertion opening.

2. The retention clip according to claim 1, wherein the at least one discontinuity of at least one free end comprises at least one of a recess or a protrusion.

3. The retention clip according to claim 1, wherein the at least one discontinuity of at least one free end overlaps with the cable insertion opening in the cable insertion direction.

4. The retention clip according to claim 1, wherein the at least one discontinuity of at least one free end is positioned in the middle of the corresponding edge.

5. The retention clip according to claim 1, wherein the discontinuities of both free ends are arranged opposite to each other.

6. The retention clip according to claim 1, wherein the free ends of the two curved spring sections have rounded edges.

7. The retention clip according to claim 1, wherein the free ends of the two curved spring sections are spaced apart from the center section in the cable insertion direction.

8. The retention clip according to claim 1, wherein the free ends of the two curved spring sections are angled towards the center section.

9. The retention clip according to claim 1, wherein the two curved spring sections extend away from the cable insertion opening and are curled back towards the cable insertion opening on the same face of the center section.

10. The retention clip according to claim 1, wherein the two curved spring sections are formed by spring fingers extending in a curved manner between the respective free end and base, and wherein a degree of curvature of the spring sections is equal to or greater than 180°.

11. The retention clip according to claim 10, wherein the spring fingers define parallel slits extending therethrough.

12. The retention clip according to claim 1, wherein the center section is formed by a perforated sheet section and the cable insertion opening is in the center of the sheet section.

13. The retention clip according to claim 1, wherein the retention clip comprises two guiding flaps protruding from the center section towards the cable insertion gap.

14. The retention clip according to claim 1, wherein the retention clip is made of stainless steel.

15. The retention clip according to claim 1, wherein the retention clip is symmetrical with respect to a plane extending perpendicularly to the center section.

16. A cable assembly, comprising:

a retention clip, including:

two curved spring sections, each of the two curved spring sections having a free end including at least one discontinuity along its length, and a base, the two curved spring sections being separated from each other at their respective free ends by a cable insertion gap; and a center section extending from the base of one of the two curved spring sections to the base of the other one of the two curved spring sections and comprising a cable insertion opening, wherein the cable insertion gap and the cable insertion opening are aligned, providing a through-opening extending through the retention clip in a cable insertion direction, the free ends of the two curved spring sections partly cover the cable insertion opening; and a cable passed through the cable insertion gap and the cable insertion opening of the retention clip, wherein the free ends of the two curved spring sections are elastically pressed against an outer surface of the cable.

17. The cable assembly of claim 16, wherein the at least one discontinuity comprises a recess, the recess having a depth less than a material thickness of an outer jacket of the cable.

18. A connector, comprising:

a retention clip, including:

two curved spring sections each having a free end and a base, the two curved spring sections being separated from each other at their respective free ends by a cable insertion gap; and a center section extending from the base of one of the two curved spring sections to the base of the other one of the two curved spring sections and comprising a cable insertion opening, wherein the cable insertion gap and the cable insertion opening are aligned, providing a through-opening extending through the retention clip in a cable insertion direction, and wherein each of the free ends has at least one discontinuity in a direction along its edge, the free ends of the two curved spring sections partly cover the cable insertion opening; and a connector housing having a reception chamber and a cable insertion aperture for feeding a cable into the reception chamber, the retention clip is integrated in the reception chamber with the cable insertion opening of the retention clip being aligned with the cable insertion aperture of the connector housing, the cable insertion gap of the retention clip is arranged between the cable insertion aperture and the cable insertion opening.

19. The connector according to claim 18, wherein the reception chamber defines inner walls having a complementary curvature to the curved spring sections of the retention clip.

20. The connector according to claim 19, wherein the center section of the retention clip defines barbs for engaging with the inner walls of the reception chamber.

* * * * *